US007029747B2

(12) United States Patent
Huh et al.

(10) Patent No.: US 7,029,747 B2
(45) Date of Patent: Apr. 18, 2006

(54) INTEGRAL POLISHING PAD AND MANUFACTURING METHOD THEREOF

(75) Inventors: Hyun Huh, Seoul (KR); Sang-Mok Lee, Ulsan (KR); Kee-Cheon Song, Ulsan (KR); Seung-geun Kim, Ulsan (KR); Do-Kwon Son, Busan (KR)

(73) Assignee: Korea Polyol Co., Ltd., (KR)

( * ) Notice: Subject to any disclaimer, the term of this patent is extended or adjusted under 35 U.S.C. 154(b) by 50 days.

(21) Appl. No.: 10/648,403

(22) Filed: Aug. 27, 2003

(65) Prior Publication Data

US 2005/0260928 A1 Nov. 24, 2005

(30) Foreign Application Priority Data

Sep. 17, 2002 (KR) ..... 10-2002-0056481

(51) Int. Cl.

| | |
|---|---|
| ***B32B 3/26*** | (2006.01) |
| ***B32B 7/02*** | (2006.01) |
| ***B24B 1/00*** | (2006.01) |
| ***C09K 3/14*** | (2006.01) |
| ***B24D 11/00*** | (2006.01) |

(52) U.S. Cl. ..... 428/217; 428/143; 428/147; 428/172; 428/315.5; 428/315.9; 428/318.6; 428/402.2; 451/527; 451/533; 51/296; 51/304

(58) Field of Classification Search ..... 428/143, 428/147, 158, 172, 217, 313.5, 315.5, 304.4, 428/315.9, 318.6, 402, 402.2, 402.21, 402.22, 428/409; 451/527, 533, 538; 51/293, 296, 51/300, 304

See application file for complete search history.

(56) References Cited

U.S. PATENT DOCUMENTS

| | | | | |
|---|---|---|---|---|
| 5,257,478 | A | 11/1993 | Hyde et al. | |
| 5,605,760 | A | 2/1997 | Roberts | |
| 6,027,402 | A * | 2/2000 | Oliver | 451/533 |
| 6,171,181 | B1 | 1/2001 | Roberts et al. | |
| 6,443,827 | B1 * | 9/2002 | Ryoke et al. | 451/533 |
| 6,884,156 | B1 * | 4/2005 | Prasad et al. | 451/533 |

* cited by examiner

*Primary Examiner*—Donald J. Loney
(74) *Attorney, Agent, or Firm*—Cantor Colburn LLP

(57) ABSTRACT

An integral polishing pad includes an elastic support layer and a polishing layer, which is formed on the elastic support layer and has a higher hardness than the elastic support layer. The elastic support layer and the polishing layer are made from materials chemically compatible with each other so that a structural border between the elastic support layer and the polishing layer does not exist. In addition, the integral polishing pad also includes a transparent region, which is transparent to a light source used to detect the surface state of an object being polished and integrated with the other elements of the integral polishing pad. The integral polishing pad has high planarization efficiency and uniform properties, and thus can be reliably used for polishing. In addition, the integral polishing pad prevents a congestion of a polishing slurry and facilitates delivery of the polishing slurry. The integral polishing pad does not need an adhesive for connecting elements or a process for bonding the elements, thereby simplifying manufacturing processes.

41 Claims, 7 Drawing Sheets

INTEGRAL POLISHING PAD AND MANUFACTURING METHOD THEREOF

BACKGROUND OF THE INVENTION

1. Field of the Invention

The present invention relates to a polishing pad and a manufacturing method thereof, and more particularly, to an integral polishing pad in which an elastic support layer and a polishing layer are integrated, and a manufacturing method thereof.

2. Description of the Related Art

Polishing speed and planarization performance are important in chemical mechanical polishing which is introduced for global planarization with the development of highly integrated and microscopic semiconductor devices and multilayer wiring structures. These are determined depending on the conditions of polishing equipment, the type of polishing slurry, the type of polishing pad, and the like. In particular, a polishing pad, which is in direct contact with a wafer during polishing and is an expendable element, is an important factor determining the polishing performance.

In U.S. Pat. No. 5,257,478, an improved polishing pad, which minimizes a hysteresis loss by elastically compressing and expanding with respect to down pressure induced by a wafer during a polishing operation so that planarization efficiency is improved, is disclosed. The polishing pad includes a resilient base layer, which is volume compressible, and a top planarizing layer, which is less volume compressible than the resilient base layer. These two layers are connected to each other by an incompressible adhesive. However, the resilient base layer cannot effectively act when the adhesive is nonuniformly applied, and therefore, the planarization efficiency is decreased. In addition, applying the adhesive for connection of the two layers when manufacturing the polishing pad complicates manufacturing processes.

In the meantime, it is important to accurately and quickly detect the flatness of a wafer during a polishing operation. Accordingly, polishing pads suitable for optically detecting the flatness of a wafer in situ are disclosed in U.S. Pat. Nos. 5,605,760 and 6,171,181. However, for the polishing pad disclosed in U.S. Pat. No. 5,605,760, it is necessary to punch a pad and attach a window transparent to a light beam, so manufacturing processes are complex. In addition, a gap at a connection between the transparent window and the pad hinders the delivery of a polishing slurry, and a lump of the polishing slurry collected at the gap may scratch the surface of a wafer. Since the material of the transparent window is different from that of the pad, a crack may occur around the transparent window during a polishing operation. In U.S. Pat. No. 6,171,181, the polishing pad including a transparent region formed by more quickly solidifying a predetermined region than any other region in a mold is disclosed. However, in order to manufacture this polishing pad, a special mold in which temperature can be differently adjusted depending on portions is required, and therefore, manufacturing cost is increased. Moreover, since hysteresis loss cannot be minimized only by using a pad disclosed in U.S. Pat. No. 5,605,760 or 6,171,181, an elastic support layer is also required. Here, it is necessary to form a transparent window or a transparent region in the elastic support layer, so manufacturing processes become complex.

SUMMARY OF THE INVENTION

The present invention provides an integral polishing pad with improved planarization efficiency.

The present invention also provides an integral polishing pad, which allows the flatness of a wafer to be optically detected in situ and can be easily manufactured.

The present invention also provides a method of manufacturing an integral polishing pad.

According to an aspect of the present invention, there is provided an integral polishing pad including an elastic support layer and a polishing layer, which is formed on the elastic support layer and has a higher hardness than the elastic support layer. The elastic support layer and the polishing layer are made from materials chemically compatible with each other so that a structural border between the elastic support layer and the polishing layer does not exist.

According to another aspect of the present invention, there is provided an integral polishing pad including an elastic support layer, which is at least partially transparent to a light source used to detect the surface state of an object being polished; and a polishing layer including a transparent region, which overlaps the transparent portion of the elastic support layer and is transparent to the light source, and a remaining region, except for the transparent region, which has a higher hardness than the elastic support layer. The elastic support layer, the transparent region, and the remaining region are made from materials chemically compatible with one another so that structural borders among them do not exist.

According to still another aspect of the present invention, there is provided a method of manufacturing a polishing pad. In the method, an elastic support layer is provided. Thereafter, a material for a polishing layer, which is chemically compatible with the elastic support layer and has a higher hardness than the elastic support layer, is provided on the elastic support layer. Next, the polishing layer is formed to be integrated with the elastic support layer through gelling and hardening.

Other details of preferred embodiment of the present invention are included in the detailed description of the invention and the attached drawings.

An integral polishing pad according to the present invention has high planarization efficiency and uniform properties, and thus can be reliably used for polishing. In addition, the present invention prevents a congestion of a polishing slurry, thereby preventing damage to a wafer, and facilitates delivery of the polishing slurry. Since the present invention provides an integral polishing pad, an adhesive for connecting elements or a process for bonding the elements is not required, so manufacturing processes are simplified.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1:
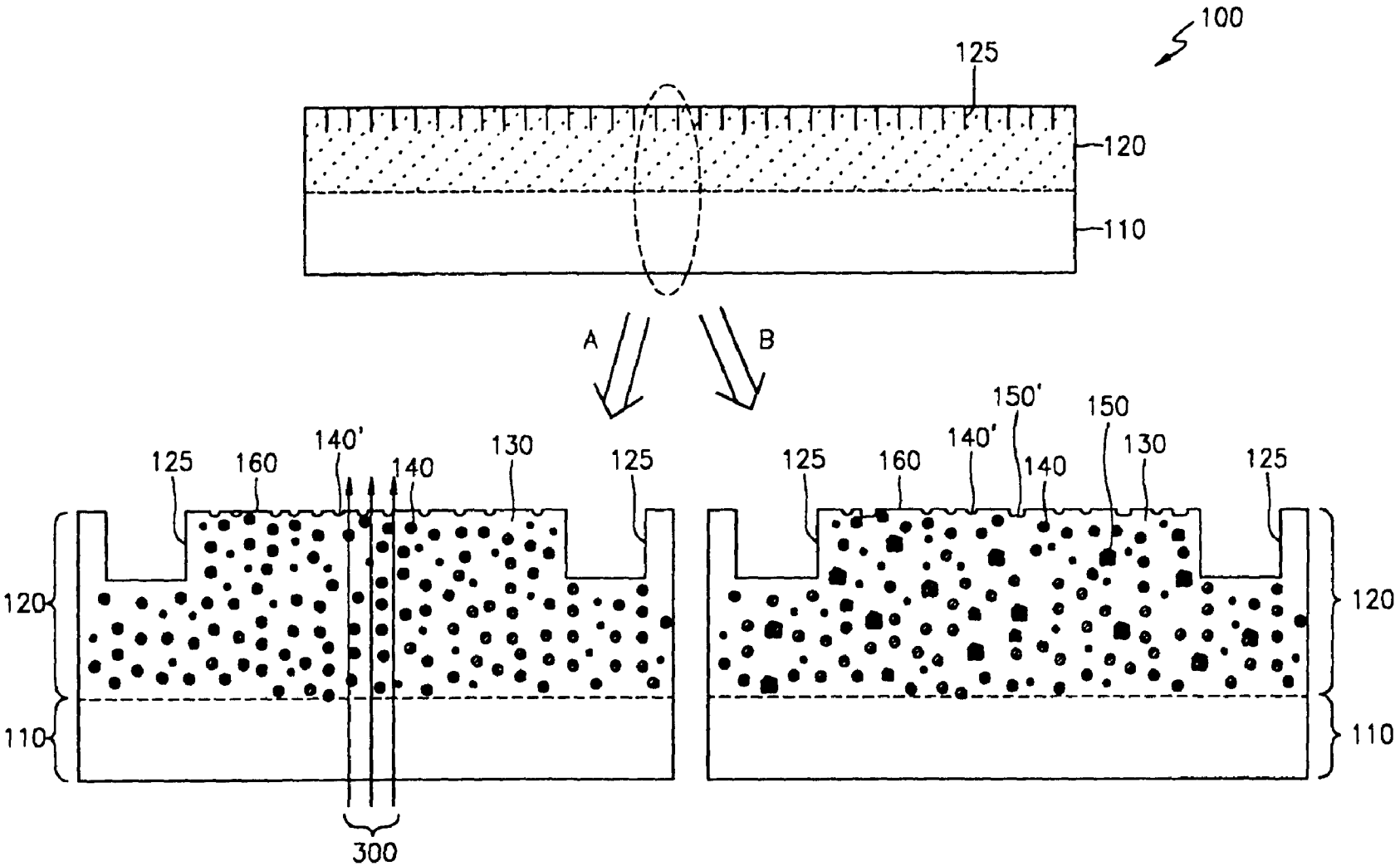
FIG. 1 is a cross-section of an integral polishing pad according to a first embodiment of the present invention.

Hereinafter, preferred embodiments of the present invention will be described in detail with reference to the attached drawings. However, this invention may be embodied in many different forms and should not be construed as being limited to the embodiments set forth herein; rather, these embodiments are provided so that this disclosure will be thorough and complete, and will fully convey the concept of the invention to those skilled in the art. The scope of the present invention is defined by the appended claims. The thickness of a support layer and a polishing layer, the size and depth of a flow channel, and the size and shape of microelements are exaggerated and simplified for clarity. In the drawings, the same reference numerals denote the same element.

Figure 2:
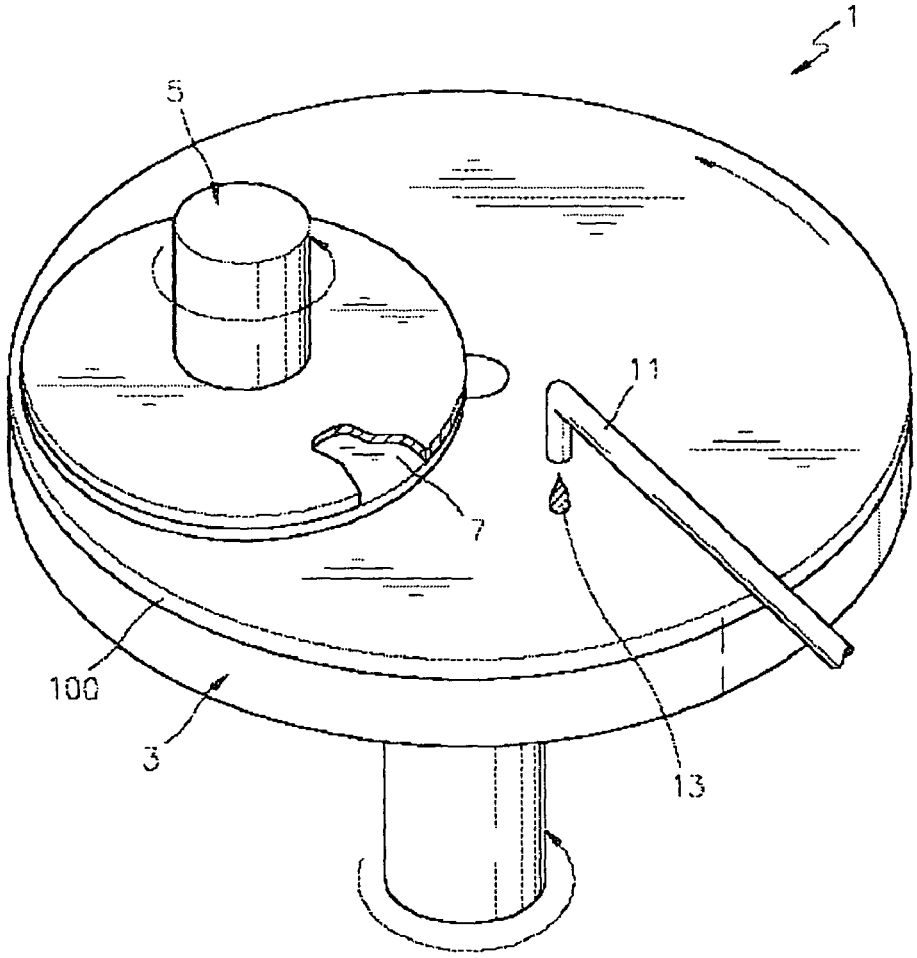
FIG. 2 is a schematic diagram of a polishing apparatus employing the integral polishing pad according to the first embodiment of the present invention.

FIG. 1 is a cross-section of an integral polishing pad 100 according to a first embodiment of the present invention. FIG. 2 is a schematic diagram of a polishing apparatus 1 employing the integral polishing pad 100 according to the first embodiment of the present invention. The integral polishing pad 100 has a circular shape to be fit into the rotary polishing apparatus 1 in FIG. 2 but can have various shapes such as a rectangle and a square depending on the shape of a polishing apparatus.

As shown in FIG. 1, the integral polishing pad 100 according to the first embodiment of the present invention includes an elastic support layer 110 and a polishing layer 120, which are integrated. The elastic support layer 110 and the polishing layer 120 are made from materials chemically compatible with each other so that a structural border does not exist between the elastic support layer 110 and the polishing layer 120. For this reason, a dotted line is used to discriminate the elastic support layer 110 from the polishing layer 120. Since the elastic support layer 110 and the polishing layer 120 are integrally formed, a special material such as an adhesive for connecting the two layers or a process for bonding the tow layers is not required.

Since the integral polishing pad 100 elastically compresses and expands with respect to down pressure induced by a wafer during a polishing operation, uniformity of a wafer surface increases. Accordingly, it is preferable that the elastic support layer 110 has a hardness of 40 to 80 shore A in order to minimize hysteresis loss. In order to increase planarization efficiency, the polishing layer 120 has a higher hardness than the elastic support layer 110. It is preferable that the hardness of the polishing layer 120 is in a range of 40 to 80 shore D.

As shown in FIG. 2, the elastic support layer 110 serves to attach the integral polishing pad 100 to a platen 3. The elastic support layer 110 with the above-described hardness has dynamic stability against down pressure pressing a silicon wafer 7, i.e., an object being polished, which is loaded at a head 5 facing the platen 3, and thus can support the polishing layer 120 directly contacting the silicon wafer 7 at uniform elasticity with respect to the silicon wafer 7. In other words, due to an interaction between the elastic support layer 110 which is volume compressible and the polishing layer 120 which is less volume compressible than the elastic support layer 110, the planarization efficiency of the integral polishing pad 100 increases.

In order to make the elastic support layer 110 and the polishing layer 120 be integrated, they are made from chemically compatible materials. In addition, it is preferable that they are made from materials allowing casting and extrusion. Preferably, they are made from materials which do not dissolve in a polishing slurry 13, i.e., a chemical solvent used for planarization. For example, as shown in FIG. 2, the elastic support layer 110 and the polishing layer 120 are made from materials into which the polishing slurry 13 supplied through a nozzle 11 of the polishing apparatus 1 cannot infiltrate. Examples of such materials include polyurethane, polyether, polyester, polysulfone, polyacryl, polycarbonate, polyethylene, polymethylmetacrylate, polyvinyl acetate, polyvinyl chloride, polyethyleneimine, polyethersulfone, polyetherimide, polyketone, melamine, nylon, hydrocarbon fluoride, and a combination thereof. Preferably, the elastic support layer 110 and the polishing layer 120 are made from polyurethane, which is obtained by the reaction of an isocyanate prepolymer and a curing agent. The prepolymer is a precursor of a final polymer and includes an olygomer or monomer. The isocyanate prepolymer contains an average of at least two isocyanate functional groups and 4–16 weight percent of free isocyanate and is obtained by the reaction between polyol, such as polyether, polyester, or polytetramethylene glycol, and toluene diisocyanate or methylene dephenyl diisocyanate. The isocyanate prepolymer reacts with a curing agent such as polyfunctional amine, diamine, triamine, or polyfunctional hydroxyl compound to permit the formation of urea links and a cured crosslinked polymer network. Amine, such as 4,4-methylene-bis (2-chloroaniline) (referred to as MOCA), or polyether or polyester polyol can be used as a curing agent. The property of polyurethane can be adjusted by combining ingredients in various ways.

It is preferable to form a surface texture or pattern 125 comprising flow channels which together permit the polishing slurry 13 containing particles to be transported across the surface of the polishing layer 120. The flow channels may be implemented by concentric annular grooves.

In the meantime, in order to increase polishing uniformity by more facilitating collection and supply of a polishing slurry, it is preferable that the polishing layer 120 is composed of a polymeric matrix in which a plurality of microelements are embedded. A method of manufacturing a polishing layer with embedded microelements in a polymeric matrix is disclosed in a patent application filed by this applicant, titled as "Polishing Pad Containing Embedded Liquid Microelements and Method of Manufacturing the same", which is incorporated herein.

More specifically, as shown in a partially enlarged view A in FIG. 1, the polishing layer 120 is composed of a polymeric matrix 130 and liquid microelements (hereinafter, referred to as embedded liquid microelements) 140 uniformly embedded in the polymeric matrix 130. Preferably, a plurality of pores 140', which have an open microstructure and are defined by the embedded liquid microelements 140, are uniformly arranged in a polishing layer surface 160, which directly contacts the silicon wafer 7. Here, since only the embedded liquid microelements 140 are included in the polymeric matrix 130, the polishing layer 120 is semitransparent to a light source 300 which is used to optically detect the surface state, i.e., the flatness, of the silicon wafer 7 being polished. Accordingly, when the elastic support layer 110 is at least partially transparent since it is made of a nonporous solid uniform polymeric elastic material, the flatness of an object being polished can be easily and optically detected in situ during a polishing operation with the integral polishing pad 100.

Although not shown in the drawings, the elastic support layer 110 of the integral polishing pad 100 may be made of a nonporous solid uniform elastic material to be at least partially transparent, and similarly, the polishing layer 120 may be made of a nonporous solid uniform polymer to be semitransparent, so that the flatness of an object being polished can be optically detected.

Alternatively, as shown in a partially enlarged view B in FIG. 1, hollow polymeric microelements 150 may be embedded in the polymeric matrix 130 along with the embedded liquid microelements 140, and a plurality of pores 140' and 150', which have an open microstructure and are defined by the embedded liquid microelements 140 and the hollow polymeric microelements 150, may be uniformly arranged in the polishing layer surface 160, Although not shown, it is apparent that only the hollow polymeric microelements 150 may be embedded in the polymeric matrix 130.

When after the integral polishing pad 100 is installed at the polishing apparatus 1 to be in contact with the surface of the silicon wafer 7, the polishing slurry 13 is supplied to the contact between the integral polishing pad 100 and the silicon wafer 7 through the nozzle 11, the pores 140' and/or 150' distributed across the polishing layer surface 160 collect the polishing slurry 13 and uniformly supply it to the surface of the silicon wafer 7. Thereafter, when polishing is continuously performed while the silicon wafer 7 and the integral polishing pad 100 are moved relative to each other, the polishing layer surface 160 is abraded, exposing the embedded liquid microelements 140 and/or the hollow polymeric microelements 150. The exposed embedded liquid microelements 140 and/or hollow polymeric microelements 150 form pores 140' and/or 150' serving to collect and supply the polishing slurry 13. Accordingly, it is preferable that the pores 140' and/or 150' arranged in the polishing layer surface 160 and that the embedded liquid microelements 140 and/or the hollow polymeric microelements 150 are uniformly distributed in the polymeric matrix 130.

The embedded liquid microelements 140 are formed of a liquid material, which is incompatible with the polymeric matrix 130, for example, aliphatic mineral oil, aromatic mineral oil, silicon oil without a hydroxyl group in a molecule, soybean oil, coconut oil, palm oil, cotton seed oil, camellia oil, hardened oil, or a combination thereof. The liquid material preferably has a molecular weight of 200–5000 and more preferably has a molecular weight of 200–1000. When the liquid material has a weight of 200 or less, the liquid material leaks during curing, so the concentration of the embedded liquid microelements 140 within the polymeric matrix 130 decreases. Conversely, when the liquid material has a weight of 5000 or greater, it is difficult to mix the liquid material with a material for the polymeric matrix 130 due to a high viscosity, so it is difficult to uniformly form the embedded liquid microelements 140.

Preferably, the embedded liquid microelements 140 are dispersively formed in a micro spherical shape within the polymeric matrix 130. The diameter of spheres is preferably in a range of 5–60 μm and more preferably in a range of 10–30 μm. The diameter in the range of 10–30 μm is most optimal to the collection and supply of a polishing slurry. However, the diameter of spheres can be changed depending on a type of polishing slurry, and the size of the embedded liquid microelements 140 is also changed.

The size of the embedded liquid microelements 140, i.e., the diameter of spheres, can be easily and variously adjusted by adjusting a weight ratio of a liquid material for the embedded liquid microelements 140 to a material for the polymeric matrix 130. Preferably, 20–50 weight percent of, and more preferably, 30–40 weight percent of a liquid material, based on the total weight of polyurethane, for the polymeric matrix 130, is used to obtain the desired size of the embedded liquid microelements 140. When the content of the liquid material is less than 20 weight percent, the size of the embedded liquid microelements 140 increases, and consequently, the size of the pores 140' formed in the polishing layer surface 160 also increases. In this case, a removal rate increases due to an increase of collected polishing slurry in the pores, but it is difficult to perform precise polishing. In addition, if the polishing slurry contains nonuniform large particles, the large particles of the polishing slurry are collected, and therefore, scratches occur on the surface of a wafer. Conversely, when the content of the liquid material exceeds 50 weight percent, a large amount of the liquid material leaks during the manufacture of a polishing pad, so it is difficult to handle the polishing pad. Moreover, the manufactured polishing pad exhibits a decreasing removal rate.

The size of the embedded liquid microelements 140 can be easily and variously adjusted by adjusting the amount of a dispersing agent. It is preferable that the content of the dispersing agent is 1–5 weight percent, based on the total weight of polyurethane, for the polymeric matrix 130. When the content of the dispersing agent is less than 1 weight percent, the dispersive ability for a liquid material decreases, and thus the liquid material is not uniformly mixed with material for the polymeric matrix 130. When the content of the dispersing agent exceeds 5 weight percent, the surface tension of a reaction system decreases and micro gas within the reaction system expands due to the heat of reaction, and to thus form pin holes in the polishing pad. Preferably, the dispersing agent is a surfactant.

In other words, since the size of the embedded liquid microelements 140 and the size of the pores 140' can be variously adjusted by adjusting the amount of the liquid material and/or the amount of the dispersing agent, polishing pads having various performance can be manufactured depending on a type of object being polished and/or a type of polishing slurry.

The hollow polymeric microelements 150 include inorganic salts, sugars, water-soluble gums, or resins. Examples of the hollow polymeric microelements 150 include polyvinyl alcohol, pectin, polyvinyl pyrrolidone, hydroxyethyl cellulose, methyl cellulose, hydropropylmethyl cellulose, carboxymethyl cellulose, hydroxypropyl cellulose, polyacrylic acid, polyacrylamide, polyethylene glycol, polyhydroxyether acrylate, starch, maleic acid copolymer, polyurethane, and combinations thereof. These materials and equivalents can be made using any method widely known in the art.

Figure 3:
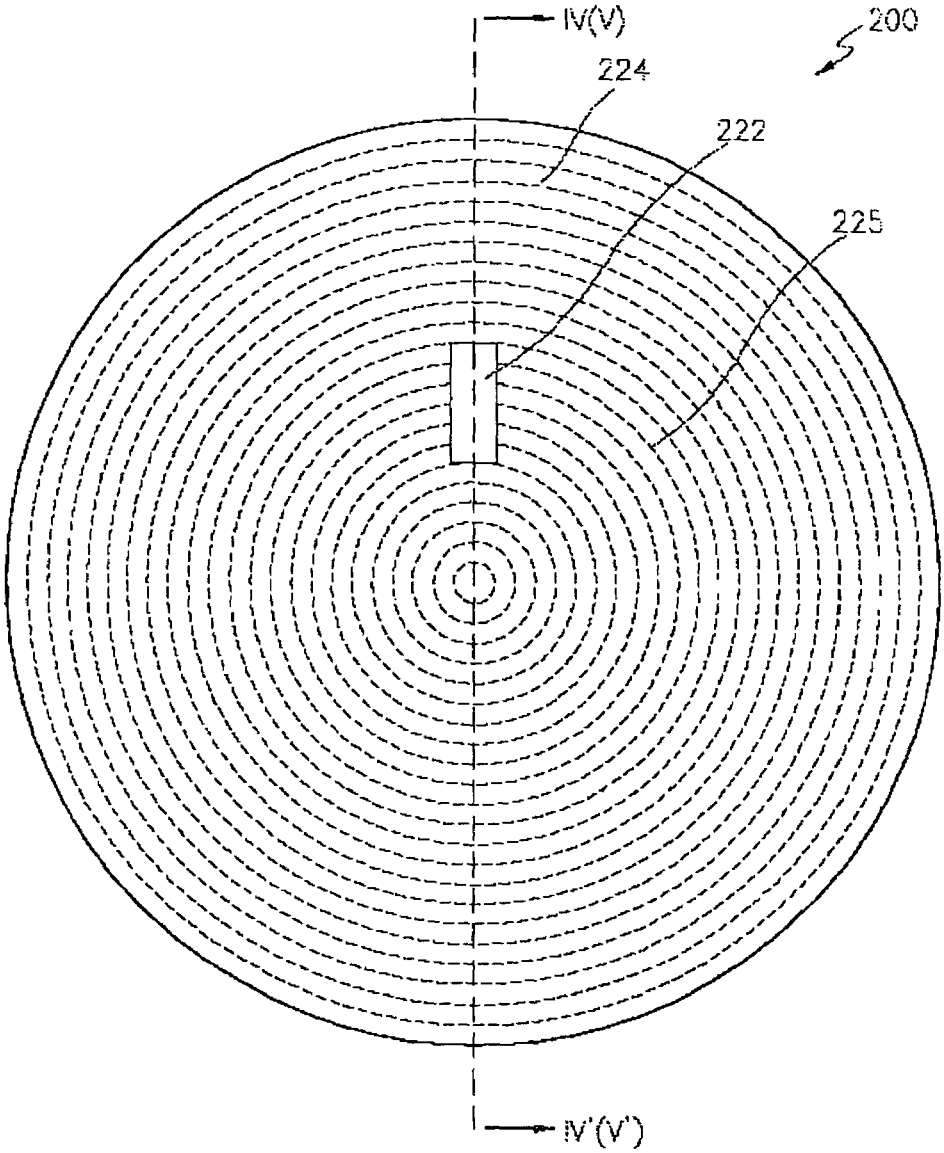
FIG. 3 is a plane view of the integral polishing pad according to the second embodiment of the present invention.
Figure 4:
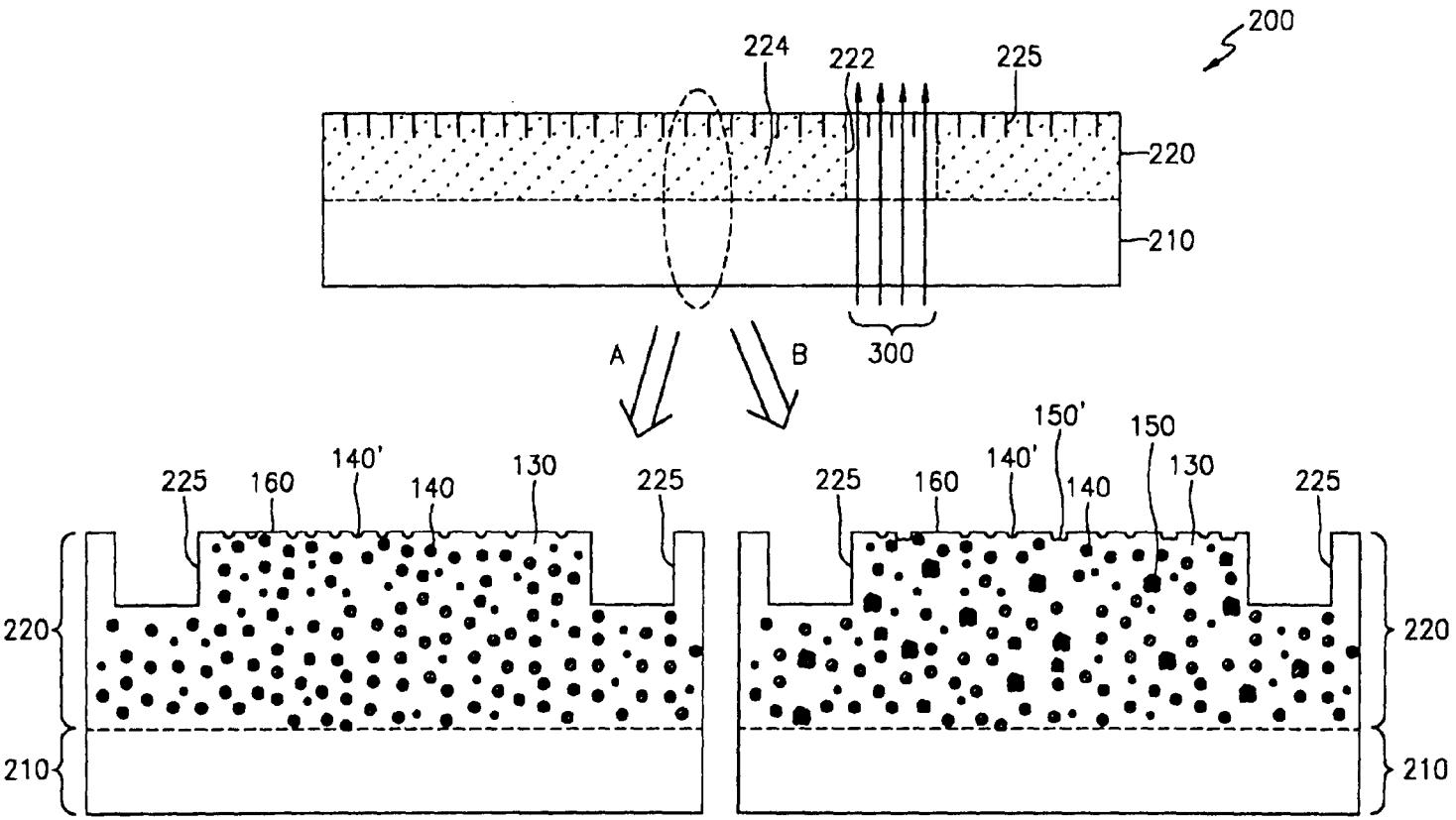
FIG. 4 is a cross-section of an integral polishing pad according to a second embodiment of the present invention.

FIG. 3 is a plane view of an integral polishing pad according to a second embodiment of the present invention. FIG. 4 is a cross-section of the integral polishing pad shown in FIG. 3, taken along the line IV–IV'.

The integral polishing pad 200 of the second embodiment additionally includes a transparent region 222 transparent to the light source 300 which is used to optically detect the surface state, i.e., the flatness, of a wafer being polished. A texture or pattern 225 including a flow channel is formed in the surface of the integral polishing pad 200 in order to facilitate delivery of a polishing slurry. As shown in FIG. 4, an elastic support layer 210, the transparent region 222, and a remaining region 224 are integrated in the integral polishing pad 200. Since the elastic support layer 210, the transparent region 222, and the remaining region 224 are made from materials chemically compatible with each other, the integral polishing pad 200 has no structural borders. For this reason, dotted lines are used to discriminate the elastic support layer 210, the transparent region 222, and the remaining region 224 from one another.

The elastic support layer 210 is at least partially transparent to the light source 300 used to detect the surface state of an object being polished. The remaining region 224 of the polishing layer 220 except for the transparent region 222 is formed on the elastic support layer 210 and has a higher hardness than the elastic support layer 210. The transparent region 222 of the polishing layer 220 is disposed to overlap the transparent portion of the elastic support layer 210 so that the light source 300 passes through the integral polishing pad 200. Consequently, the surface state, i.e., the flatness, of an object being polished, for example, a wafer, can be detected.

Similarly to the first embodiment, the elastic support layer 210 has a hardness of 40 to 80 shore A in order to minimize hysteresis loss, which occurs when the integral polishing pad 200 elastically compresses and expands with respect to down pressure induced by a wafer during a polishing operation, thereby increasing polishing uniformity. In order to increase planarization efficiency, the remaining region 224 of the polishing layer 220 except for the transparent region 222 has a hardness of 40 to 80 shore D.

The functions and materials of the elastic support layer 210 and the remaining region 224 of the polishing layer 220 are the same as those of the elastic support layer 110 and the polishing layer 120 according to the first embodiment, and thus a description thereof will be omitted.

However, since the elastic support layer 210 needs to be partially or entirely transparent to the light source 300, it is preferable that the elastic support layer 210 is made using a nonporous solid uniform polymer.

Like the polishing layer 120 of the first embodiment, the remaining region 224 of the polishing layer 220 except for the transparent region 222 may be composed of a polymeric matrix in which a plurality of microelements are embedded and a plurality of pore are distributed across the surface of the polymeric matrix in order to facilitate the collection and supply of a polishing slurry. More specifically, as shown in a partially enlarged view A in FIG. 4, the embedded liquid microelements 140 may be included in the polymeric matrix 130, the hollow polymeric microelements 150 may be included in the polymeric matrix 130 along with the embedded liquid microelements 140, or although not shown, only the hollow polymeric microelements 150 may be included in the polymeric matrix 130. The materials of the polymeric matrix 130, the embedded liquid microelements 140, and the hollow polymeric microelements 150 are the same as those described in the first embodiment, and thus descriptions thereof will be omitted.

The transparent region 222 of the polishing layer 220 is made of an organic polymer or an inorganic material coated with an organic polymer, which is chemically compatible with the elastic support layer 210 and the remaining region 224 of the polishing layer 220 and transparent to the light source 300. The organic polymer may be a polyurethane, polyester, nylon, acryl resin, epoxy resin, polyethylene, polystyrene, polyvinyl chloride, polytetrafluoroethylene, polyvinylidene fluoride, polyether sulfone, or a combination thereof. Among them, polyurethane is most preferable. The inorganic material may be glass. The inorganic material is coated with the organic material in order to prevent a wafer from being damaged and allow the transparent region 222 to be integrated with the elastic support layer 210 and the remaining region 224.

Figure 5:
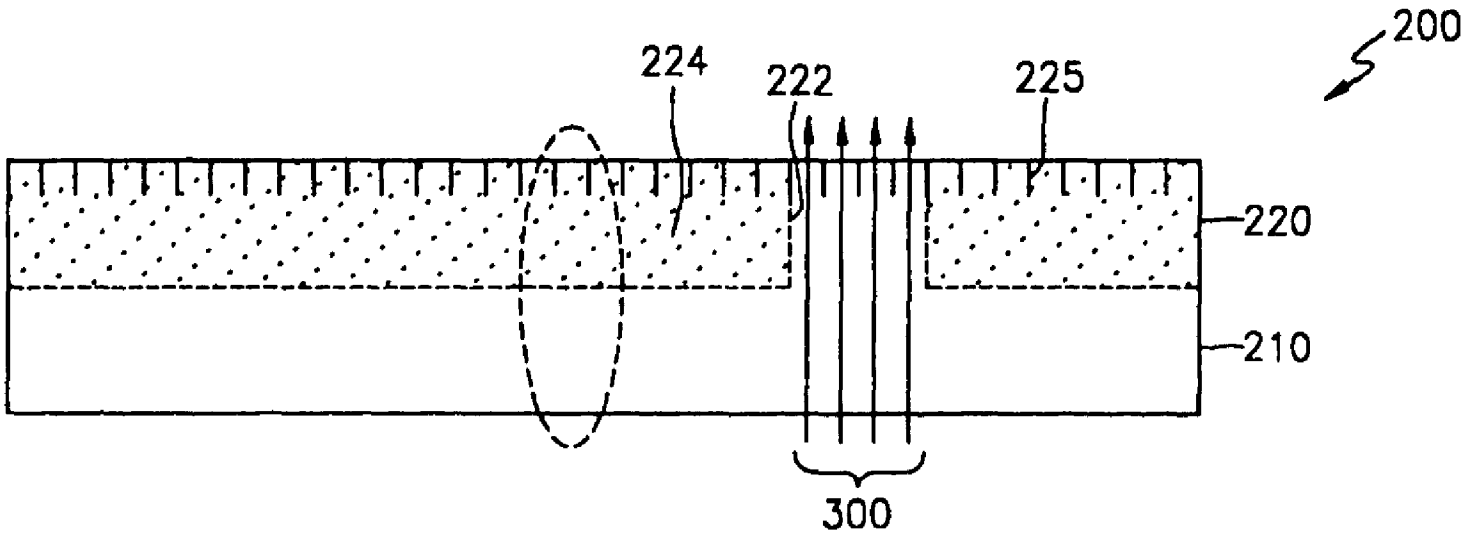
FIG. 5 is a cross-section of a modified example of the second embodiment of the present invention.

FIG. 5 is a cross-section of a modified example of an integral polishing pad according to the second embodiment of the present invention. Unlike the second embodiment of the present invention shown in FIG. 4, the transparent region 222 of the polishing layer 220 is formed to extend and protrude from the elastic support layer 210 so that the transparent region 222 is inserted into the remaining region 224 of the polishing layer 220.

Hereinafter, a method of manufacturing the integral polishing pad according to the second embodiment will be described with reference to FIG. 6.

A support layer is formed in step S600. Ingredients of the support layer are mixed and then made into the support layer through a method, such as casting or extrusion, which is known to those skilled in the field of polymer sheet manufacturing.

Next, the support layer is laid in a mold, and a transparent element is provided in a partial area on the support layer. The provision of the transparent element means that a transparent window, which is separately made of a material for a transparent region, is provided on the support layer in step S600A, or that the material for the transparent region is injected into a casting cavity defining the transparent region within the mold in which the support layer is laid instep S600B.

Subsequently, materials for the remaining region of a polishing layer except for the transparent region are injected into the cast to fill the mold in step S620. The kinds and contents of the materials for the remaining region of the polishing layer have been described above, and thus detailed descriptions thereof will be omitted. For the remaining region of the polishing layer, a material for a polymeric matrix is mixed with a liquid material and/or a hollow polymer at the above described content ratio. When mixing them, a dispersing agent may be used to uniformly disperse the liquid material within the material in the polymeric matrix. It is preferable to use an agitation method for dispersion and mixing.

Thereafter, integration is performed through gelling and hardening reactions in step S630. The resultant structure is subjected to the gelling reaction for 5–30 minutes at 80–90° C. and then to the hardening reaction for 20–24 hours at 80–120° C. However, processing temperature and time can vary. That the polishing layer and the support layer are chemically compatible with each other and thus integrated means that the materials of the two layers are uniformly mixed by melting or solution at the interface between the two layers because the materials have the same chemical structure, the materials have functional groups allowing physical interaction within their chemical structures, or there is a compatibilizer even if the materials are chemically different, and the mixture of the materials of the two layers gels and is then hardened to have a single phase. Since the materials for the support layer, the transparent region, and the remaining region of the polishing layer are chemically compatible, once the gelling and hardening reactions are completed, the support layer and the transparent region and the remaining region of the polishing layer are integrated so that no structural borders exist among them.

Next, the hardened resultant structure having a predetermined shape is processed in step S640. The resultant structure is processed through taking off the cast, cutting, surface treatment, and cleaning. First, the hardened resultant structure is taken out of the cast and cut to have a predetermined thickness and shape. It is preferable to form a structure or pattern including flow channels having various shapes in a surface of the polishing layer so that a polishing slurry can be uniformly supplied throughout the surface of the polishing layer. After a cleaning process, the polishing layer is completed. When embedded liquid microelements exist within the remaining region of the polishing layer except for the transparent region, during the cleaning, the embedded liquid microelements exposed at the surface of the polishing layer flow out, and thus open pores are formed in the surface of the polishing layer. Here, it is preferable to use a liquid cleaner to remove the embedded liquid microelements from the surface of the polishing layer.

Figure 7:
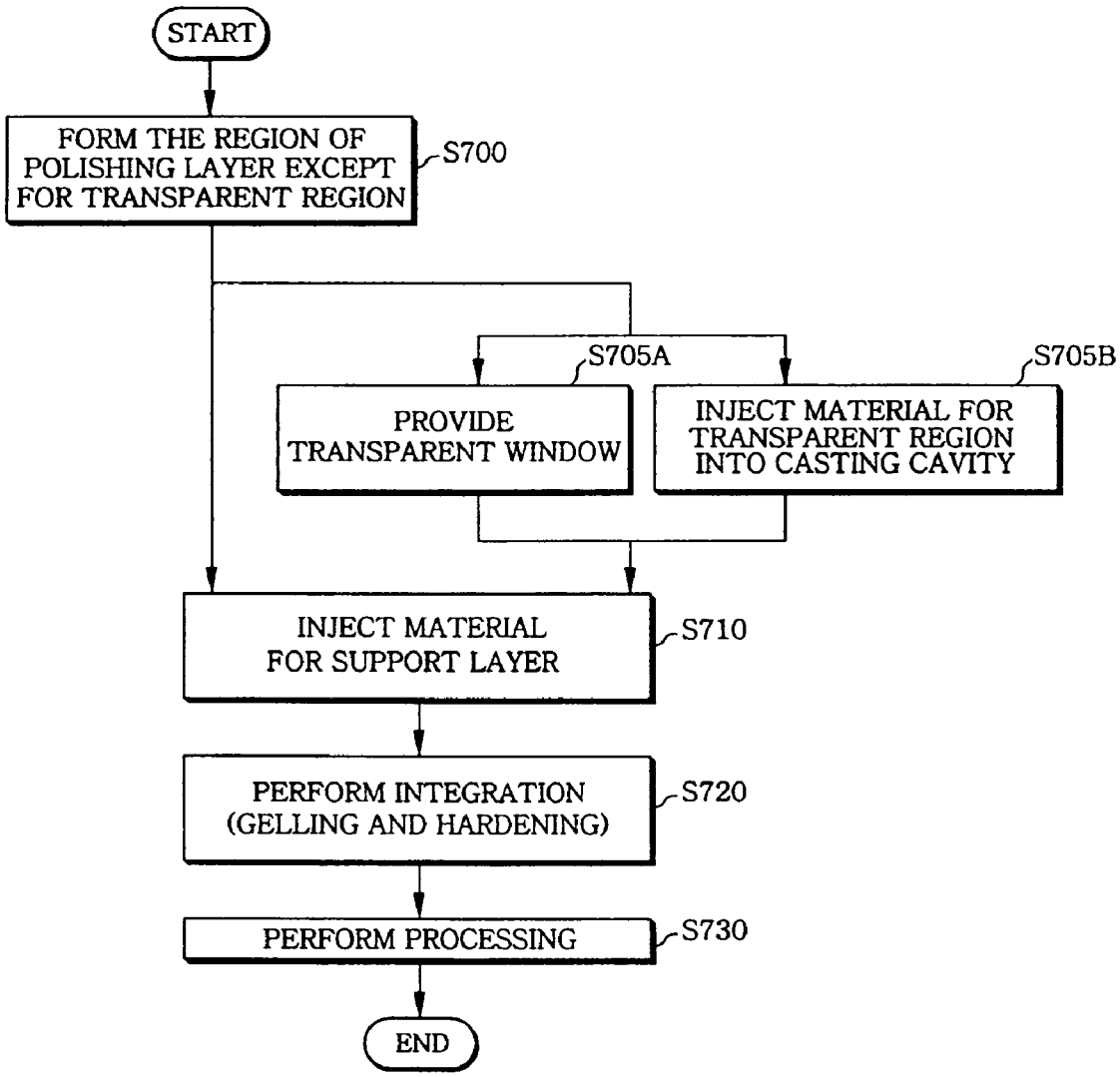
FIG. 7 is a flowchart of a method of manufacturing the modified example of the second embodiment of the present invention.

FIG. 7 is a flowchart of a method of manufacturing the modified example of the second embodiment of the present invention.

A remaining region of a polishing layer except for a transparent region is formed in step S700. Materials for the remaining region of the polishing layer are mixed and then made into the remaining region of the polishing layer through a method, such as casting or extrusion, which is known to those skilled in the field of polymer sheet manufacturing. Here, it is preferable to form an empty space for the transparent region in the polishing layer. The empty space can be easily formed by separately defining a portion, in which the transparent region is to be formed, within a mold used to form the polishing layer. Alternatively, after a single sheet is formed, the single sheet may be punched at a portion in which the transparent region is to be formed.

Thereafter, a material for a support layer is injected into the mold, in which the remaining region of the polishing layer except for the transparent region, in step S710. The material for the support layer fills the empty space within the mold, thereby forming the support layer and the transparent region.

Before injecting the material for the support layer, a transparent element may be provided in the empty space formed in the remaining region of the polishing layer so that the integral polishing pad shown in FIG. 4 can be formed. The transparent element is provided by injecting a material for the transparent region in step S705B or providing a transparent window, which is separately made of a material for the transparent region, in step S705A.

Figure 6:
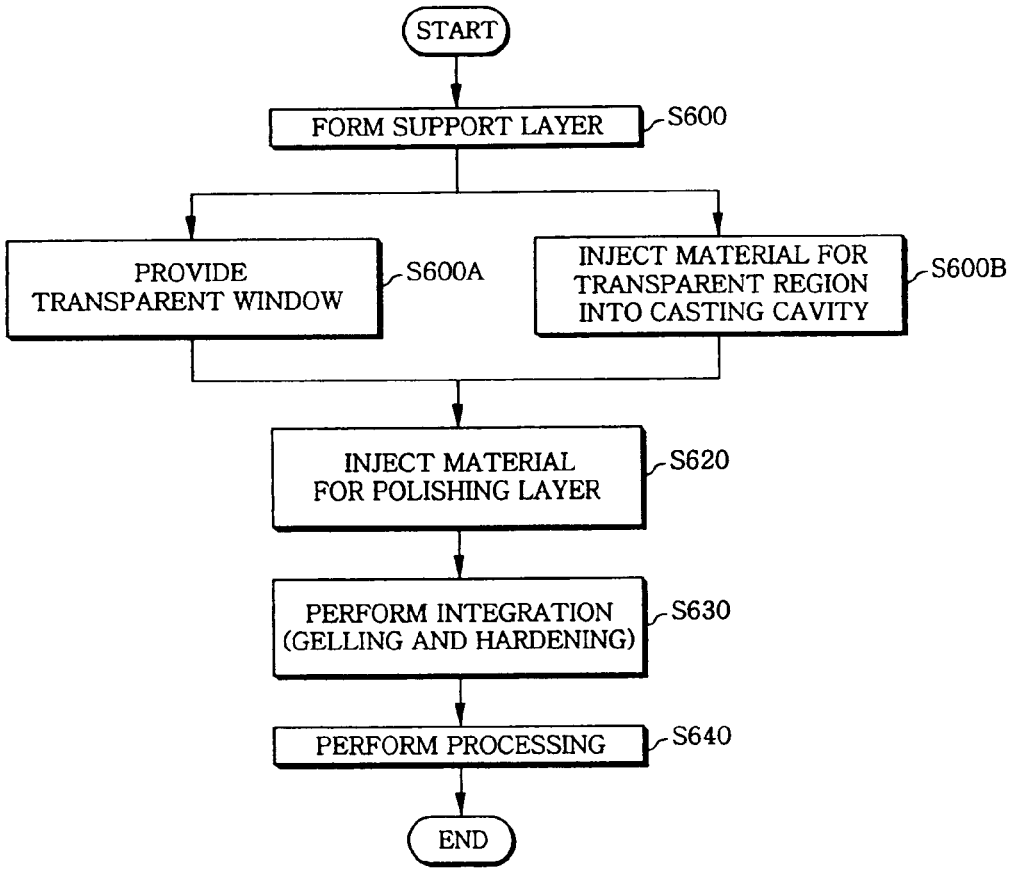
FIG. 6 is a flowchart of a method of manufacturing the integral polishing pad according to the second embodiment of the present invention.

Thereafter, gelling and hardening reactions for integration in step S720 and final processing in step S730 are performed in the same manner as used in the method shown in FIG. 6. The above-described methods can vary to be suitable for mass production.

A method of manufacturing the integral polishing pad according to the first embodiment of the present invention can be easily inferred from those skilled in the art from the methods of respectively manufacturing the integral polishing pad according to the second embodiment and the modified example of the second embodiment, and thus a detailed description thereof will be omitted.

EXPERIMENTAL EXAMPLE 1

A reaction was commenced by mixing 100 g of a polyether-based isocyanate prepolymer (having an NCO content of 16%) with 100 g of polypropylene glycol at room temperature. Under the condition that a low viscosity is maintained, the mixed liquid was poured into a mold maintained at 80±1° C. Then, the resulting product was taken out and post cured for 20 hours in an oven maintained at 100° C. The cure product was cut to have a predetermined size, thereby forming a support layer. A sheet having a thickness of 1 mm was manufactured in the same manner as the support layer and cut to have a size of 20×50 mm, thereby manufacturing a transparent window.

The manufactured support layer was laid in a mold having a predetermined size, the transparent window was put on the surface of the support layer, and the temperature of the mold was set to 50° C.

100 g of a polyether-based isocyanate prepolymer (having an NCO content of 11%), 23.3 g of mineral oil (hereinafter, referred to as KF-70 (Seojin Chemical)), 5 g of nonylphenol ethoxylate (hereinafter, referred to as NP-2 (Korea Polyol)) were mixed. As a hollow polymer, 1.2 g of EXPANCEL 091 DE powder with particles having a size of 30–130 μm was blended with the mixture using a Homo mixer for 2 minutes at a rate of 2000 rpm to be thus uniformly dispersed. The mixture was then mixed with 33 g of MOCA at room temperature and immediately injected into the mold prepared in advance. Thereafter, gelling was performed for 30 minutes, and thereafter, curing was performed for 20 hours at 100° C. in an oven. The cured product was taken out of the mold and cut, thereby forming an integral polishing pad.

EXPERIMENTAL EXAMPLE 2

An integral polishing pad was manufactured in the same manner as used in Experimental Example 1, with the exception that 46 g of KF-70 was used and EXPANCEL was not used.

EXPERIMENTAL EXAMPLE 3

A polishing layer was manufactured in the same manner as used in Experimental Example 1. A predetermined portion of the polishing layer was punched in a size of 20×50 mm to form an empty space and then laid in a mold having a predetermined size. The temperature of the mold was set to 50° C.

A urethane reaction material manufactured by the same method as the transparent window was manufactured in Experimental Example 1 was injected into the empty space in the polishing layer within the mold. Thereafter, as in Experimental Example 1, a urethane reaction material for a support layer was injected into the mold. Next, gelling was performed for 30 minutes, and thereafter, curing was performed for 20 hours at 100° C. in an oven. The cured product was taken out of the mold and cut, thereby forming an integral polishing pad.

In an integral polishing pad according to the present invention, since an elastic support layer is integrated with a polishing layer, planarization efficiency with respect to an object being polished is increased. Since the entire integral polishing pad has a sheet shape, the properties of the integral polishing pad are uniform so that a polishing operation can be reliably performed. In addition, since a transparent region is integrated in an integral polishing pad, there is no gap at a connection between the polishing layer and the transparent region so that a congestion of a polishing slurry and scratches due to the congestion are remarkably decreased. Grooves can be formed in the surface of the transparent region in order to facilitate delivery of a polishing slurry so that the polishing slurry uniformly flows throughout the surface of the integral polishing pad. Moreover, the present invention allows the flatness of an object being polished to be optically and easily detected in situ during a polishing operation.

Since the elastic support layer and the transparent region and the remaining region of the polishing layer are integrated, processes such as bonding of layers, punching of a pad to form a transparent region, and bonding of a transparent element to the pad are not required. Accordingly, manufacturing processes are simplified.

What is claimed is:

1. An integral polishing pad which performs a polishing operation by moving in contact with a surface of an object being polished, the integral polishing pad comprising:

an elastic support layer, which is made of a nonporous solid uniform polymer and at least partially transparent to a light source used to detect the surface state of the object being polished; and a polishing layer, which is formed on the elastic support layer and semitransparent to the light source, and has a higher hardness than the elastic support layer, wherein the elastic support layer and the polishing layer are made of materials chemically compatible with each other so that a structural border between the elastic support layer and the polishing layer does not exist, and the polishing layer comprises a polymeric matrix made from a material chemically compatible with the elastic support layer and a plurality of liquid microelements embedded in the polymeric matrix, and a plurality of open pores defined by the embedded liquid microelements are distributed across a surface of the polishing layer.

2. The integral polishing pad of claim 1, wherein the elastic support layer has a hardness of 40 to 80 shore A.

3. The integral polishing pad of claim 1, wherein the polishing layer has a hardness of 40 to 80 shore D.

4. The integral polishing pad of claim 1, wherein each of the elastic support layer and the polishing layer comprises at least one material selected from the group consisting of polyurethane, polyether, polyester, polysulfone, polyacryl, polycarbonate, polyethylene, polymethylmetacrylate, polyvinyl acetate, polyvinyl chloride, polyethyleneimine, polyethersulfone, polyetherimide, polyketone, melamine, nylon, and hydrocarbon fluoride.

5. The integral polishing pad of claim 1, wherein when the surface of the polishing layer is abraded during the polishing operation, the embedded liquid microelements are exposed at the surface of the polishing layer so that the open pores are continuously formed.

6. The integral polishing pad of claim 1, wherein a material for the embedded liquid microelements is a liquid material which is chemically incompatible with the polymeric matrix.

7. The integral polishing pad of claim 6, wherein the liquid material comprises at least one material selected from the group consisting of aliphatic mineral oil, aromatic mineral oil, silicon oil without a hydroxyl group in a molecule, soybean oil, coconut oil, palm oil, cotton seed oil, camellia oil, and hardened oil.

8. The integral polishing pad of claim 7, wherein the content of the liquid material is 20–50 weight percent, based on the total weight of a material for the polymeric matrix.

9. The integral polishing pad of claim 1, wherein the polishing layer comprises a polymeric matrix made from a material chemically compatible with the elastic support layer and a plurality of embedded liquid microelements and hollow polymeric microelements, which are included within the polymeric matrix, and a plurality of open pores, which are defined by the embedded liquid microelements and the hollow polymeric microelements, are distributed across a surface of the polishing layer.

10. The integral polishing pad of claim 1, further comprising a structure or pattern including a flow channel in a surface of the polishing layer in order to facilitate delivery of a polishing slurry.

11. The integral polishing pad of claim 1, wherein the polishing layer comprises a transparent region, which overlaps the transparent portion of the elastic support layer and is transparent to the light source, and a remaining region, except for the transparent region, which has a higher hardness than the elastic support layer, and the elastic support layer, the transparent region, and the remaining region are made from materials chemically compatible with one another so that structural borders among them do not exist.

12. The integral polishing pad of claim 11, wherein the elastic support layer has a hardness of 40 to 80 shore A.

13. The integral polishing pad of claim 11, wherein the remaining region of the polishing layer except for the transparent region has a hardness of 40 to 80 shore D.

14. The integral polishing pad of claim 11, wherein each of the elastic support layer and the remaining region of the polishing layer comprises at least one material selected from the group consisting of polyurethane, polyether, polyester, polysulfone, polyacryl, polycarbonate, polyethylene, polymethylmetacrylate, polyvinyl acetate, polyvinyl chloride, polyethyleneimine, polyethersulfone, polyetherimide, polyketone, melamine, nylon, and hydrocarbon fluoride.

15. The integral polishing pad of claim 11, wherein the transparent region is made of an organic polymer or an inorganic material coated with the organic polymer.

16. The integral polishing pad of claim 15, wherein the organic polymer comprises at least one material selected from the group consisting of a polyurethane, polyester, nylon, acryl resin, epoxy resin, polyethylene, polystyrene, polyvinyl chloride, polytetrafluoroethylene, polyvinylidene fluoride, and polyether sulfone.

17. The integral polishing pad of claim 16, wherein the elastic support layer is made of a nonporous solid uniform polymeric elastic material.

18. The integral polishing pad of claim 11, wherein the remaining region of the polishing layer except for the transparent region comprises a polymeric matrix made from a material chemically compatible with the elastic support layer and a plurality of embedded liquid microelements and/or hollow polymeric microelements, which are included within the polymeric matrix, and a plurality of open pores, which are defined by the embedded liquid microelements and/or the hollow polymeric microelements, are distributed across a surface of the polishing layer.

19. The integral polishing pad of claim 18, wherein when the surface of the polishing layer is abraded during the polishing operation, the embedded liquid microelements and/or the hollow polymeric microelements are exposed at the surface of the polishing layer so that the open pores are continuously formed.

20. The integral polishing pad of claim 18, wherein a material for the embedded liquid microelements is a liquid material which is chemically incompatible with the polymeric matrix.

21. The integral polishing pad of claim 20, wherein the liquid material comprises at least one material selected from the group consisting of aliphatic mineral oil, aromatic mineral oil, silicon oil without a hydroxyl group in a molecule, soybean oil, coconut oil, palm oil, cotton seed oil, camellia oil, and hardened oil.

22. The integral polishing pad of claim 20, wherein the content of the liquid material is 20–50 weight percent, based on the total weight of a material for the polymeric matrix.

23. The integral polishing pad of claim 11, further comprising a texture or pattern including a flow channel in a surface of the polishing layer in order to facilitate delivery of a polishing slurry.

24. The integral polishing pad of claim 2, wherein the polishing layer comprises a polymeric matrix made from a material chemically compatible with the elastic support layer and a plurality of embedded liquid microelements and hollow polymeric microelements, which are included within the polymeric matrix, and a plurality of open pores, which are defined by the embedded liquid microelements and the hollow polymeric microelements, are distributed across a surface of the polishing layer.

25. The integral polishing pad of claim 3, wherein the polishing layer comprises a polymeric matrix made from a material chemically compatible with the elastic support layer and a plurality of embedded liquid microelements and hollow polymeric microelements, which are included within the polymeric matrix, and a plurality of open pores, which are defined by the embedded liquid microelements and the hollow polymeric microelements, are distributed across a surface of the polishing layer.

26. The integral polishing pad of claim 4, wherein the polishing layer comprises a polymeric matrix made from a material chemically compatible with the elastic support layer and a plurality of embedded liquid microelements and hollow polymeric microelements, which are included within the polymeric matrix, and a plurality of open pores, which are defined by the embedded liquid microelements and the hollow polymeric microelements, are distributed across a surface of the polishing layer.

27. The integral polishing pad of claim 12, wherein the remaining region of the polishing layer except for the transparent region comprises a polymeric matrix made from a material chemically compatible with the elastic support layer and a plurality of embedded liquid microelements and/or hollow polymeric microelements, which are included within the polymeric matrix, and a plurality of open pores, which are defined by the embedded liquid microelements and/or the hollow polymeric microelements, are distributed across a surface of the polishing layer.

28. The integral polishing pad of claim 12, wherein when the surface of the polishing layer is abraded during the polishing operation, the embedded liquid microelements and/or the hollow polymeric microelements are exposed at the surface of the polishing layer so that the open pores are continuously formed.

29. The integral polishing pad of claim 12, wherein a material for the embedded liquid microelements is a liquid material which is chemically incompatible with the polymeric matrix.

30. The integral polishing pad of claim 12, wherein the liquid material comprises at least one material selected from the group consisting of aliphatic mineral oil, aromatic mineral oil, silicon oil without a hydroxyl group in a molecule, soybean oil, coconut oil, palm oil, cotton seed oil, camellia oil, and hardened oil.

31. The integral polishing pad of claim 12, wherein the content of the liquid material is 20–50 weight percent, based on the total weight of a material for the polymeric matrix.

32. The integral polishing pad of claim 13, wherein the remaining region of the polishing layer except for the transparent region comprises a polymeric matrix made from a material chemically compatible with the elastic support layer and a plurality of embedded liquid microelements and/or hollow polymeric microelements, which are included within the polymeric matrix, and a plurality of open pores, which are defined by the embedded liquid microelements and/or the hollow polymeric microelements, are distributed across a surface of the polishing layer.

33. The integral polishing pad of claim 13, wherein when the surface of the polishing layer is abraded during the polishing operation, the embedded liquid microelements and/or the hollow polymeric microelements are exposed at the surface of the polishing layer so that the open pores are continuously formed.

34. The integral polishing pad of claim 13, wherein a material for the embedded liquid microelements is a liquid material which is chemically incompatible with the polymeric matrix.

35. The integral polishing pad of claim 13, wherein the liquid material comprises at least one material selected from the group consisting of aliphatic mineral oil, aromatic mineral oil, silicon oil without a hydroxyl group in a molecule, soybean oil, coconut oil, palm oil, cotton seed oil, camellia oil, and hardened oil.

36. The integral polishing pad of claim 13, wherein the content of the liquid material is 20–50 weight percent, based on the total weight of a material for the polymeric matrix.

37. The integral polishing pad of claim 14, wherein the remaining region of the polishing layer except for the transparent region comprises a polymeric matrix made from a material chemically compatible with the elastic support layer and a plurality of embedded liquid microelements and/or hollow polymeric microelements, which are included within the polymeric matrix, and a plurality of open pores, which are defined by the embedded liquid microelements and/or the hollow polymeric microelements, are distributed across a surface of the polishing layer.

38. The integral polishing pad of claim 14, wherein when the surface of the polishing layer is abraded during the polishing operation, the embedded liquid microelements and/or the hollow polymeric microelements are exposed at the surface of the polishing layer so that the open pores are continuously formed.

39. The integral polishing pad of claim 14, wherein a material for the embedded liquid microelements is a liquid material which is chemically incompatible with the polymeric matrix.

40. The integral polishing pad of claim 14, wherein the liquid material comprises at least one material selected from the group consisting of aliphatic mineral oil, aromatic mineral oil, silicon oil without a hydroxyl group in a molecule, soybean oil, coconut oil, palm oil, cotton seed oil, camellia oil, and hardened oil.

41. The integral polishing pad of claim 14, wherein the content of the liquid material is 20–50 weight percent, based on the total weight of a material for the polymeric matrix.

* * * * *